US005983395A

United States Patent [19]

Lei

[11] Patent Number: 5,983,395

[45] Date of Patent: Nov. 16, 1999

[54] EXTRA SENSORY GLOVE

[75] Inventor: Alan Skip Lei, 2873 S.W. Labbe Ave., Portland, Oreg. 97221

[73] Assignee: Alan Skip Lei, Portland, Oreg.

[21] Appl. No.: 09/032,178

[22] Filed: Feb. 27, 1998

[51] Int. Cl.[6] ..... A41D 19/00

[52] U.S. Cl. ..... 2/159; 2/16; 2/161.7; 2/163

[58] Field of Search ..... 2/159, 161.1, 161.3, 2/161.6, 7, 8, 164, 167, 168, 161.7, 16, 20, 163

[56] References Cited

U.S. PATENT DOCUMENTS

| | | | |
|---|---|---|---|
| 3,761,965 | 10/1973 | Barasch | 2/167 |
| 4,084,265 | 4/1978 | Anfelt | 2/167 |
| 4,745,635 | 5/1988 | Kinnear | 2/167 |
| 5,448,777 | 9/1995 | Lew | 2/159 |
| 5,467,481 | 11/1995 | Srivastava | 2/159 |
| 5,794,266 | 9/1998 | Han | 2/159 |

*Primary Examiner*—Diana L. Oleksa
*Assistant Examiner*—Katherine M. Moran

[57] ABSTRACT

A glove including a textured surface on the inside designed to bring the texture into contact with the skin on the hand. The texture is provided over the entire interior of the glove, or just over selected areas of the glove that will provide the desired sensory contact with the hand. The texture may be a uniform pattern of raised projections, or a random placement of raised projections.

9 Claims, 2 Drawing Sheets

EXTRA SENSORY GLOVE

BACKGROUND

1. Field of the Invention

The present invention relates to a device to heighten the sense of touch and feel, and more particularly, to a hand cover, or glove, having a texture on the inside in areas that correspond to sensory neurons in the hand, for example.

2. Background Information

In many daily and specialized task situations, gloves are worn to protect the palm of the hand, and in most cases the fingers, as well as to aid in grip.

In activities that rely on the sense of touch in the palm, the thumb and four fingers, gloves have proved to be a barrier between the sensory neurons of the hand, thumb and fingers. Improving the sensory elements of a glove would provide a distinct advantage to a wearer. However, gloves to date have focused on the exterior surfaces of the glove, such as that shown in U.S. Pat. No. 3,649,967 "Non-Slop Golf Glove" issued to Millman, which was designed specifically for the sport of golf. Millman provides for rubber like protuberances on the outside of the glove to prevent slippage. Until this invention, however, no attention has been paid to the lack of sensory awareness that comes with the use of a glove due to the insular nature of the glove material that comes between the hand and the object in contact with the gloved hand. This invention overcomes this limitation by providing a textured surface on the inside of the glove.

SUMMARY

Briefly, in accordance with one embodiment of the invention, a textured surface is established on the inside, or interior facing of a glove. This allows the texture of the interior facing to make contact with the skin of the hand.

The improvement of the present invention is to add a new dimension currently not offered to a glove wearer. The interior of the glove, or hand cover, is indeed the most critical facing of the hand garment with respect to "touch" and "feel," as it is here where the contact of the bare skin occurs. As pressure is applied in the gripping motion to the object, the exterior of the glove is indeed what comes into contact with the desired object. The stimulation to the brain, however, is muffed by the very nature of the glove that provides a barrier of the glove material between the skin and the object. Until the present invention, it has been a tradeoff between the protection and comfort of a glove, and the loss of sensory feedback to the neurons of the hand. By utilizing the textured surface of the present invention on the inside of a glove, a heightened awareness of touch and feel can be achievable even though a glove is being worn. This is accomplished by the stimulation to the sensory neurons of the hand by the raised texture at each pressure point where contact is made. The result is the transmission of increased and focused "touch" and "feel" information to the brain.

In addition to the heightened feel, this invention also offers a soothing relief to the contacted area(s) achieved by the raised and stimulating textured surface on the inside facing of the glove.

BRIEF DESCRIPTION OF THE DRAWINGS

The subject matter regarded as the invention is particularly pointed out and distinctly claimed in the concluding portions of the specification. The invention, however, both as to organization and method of operation, together with objects, features and advantages thereof, may best be understood by reference to the following detailed description and read with the accompanying drawings in which:

DETAILED DESCRIPTION

Figure 1:
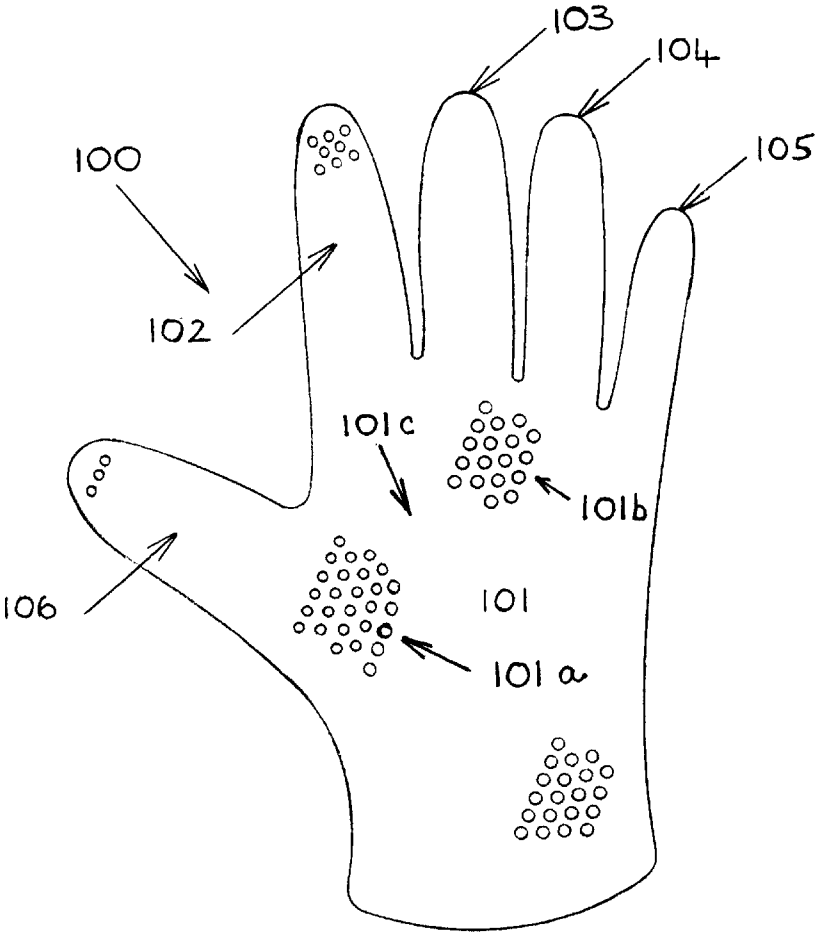
FIG. 1 is a view of the interior of a glove utilizing the present invention.

FIG. 1 illustrates an embodiment of an extra sensory glove 100 in accordance with the present invention having a texture on the interior facing. For ease in viewing, glove 100 is turned inside out to expose what is normally the interior facing, or surface, that comes in contact with the skin of the hand when worn. It will, of course, be appreciated that the invention is not limited in scope to this particular embodiment.

Figure 5:
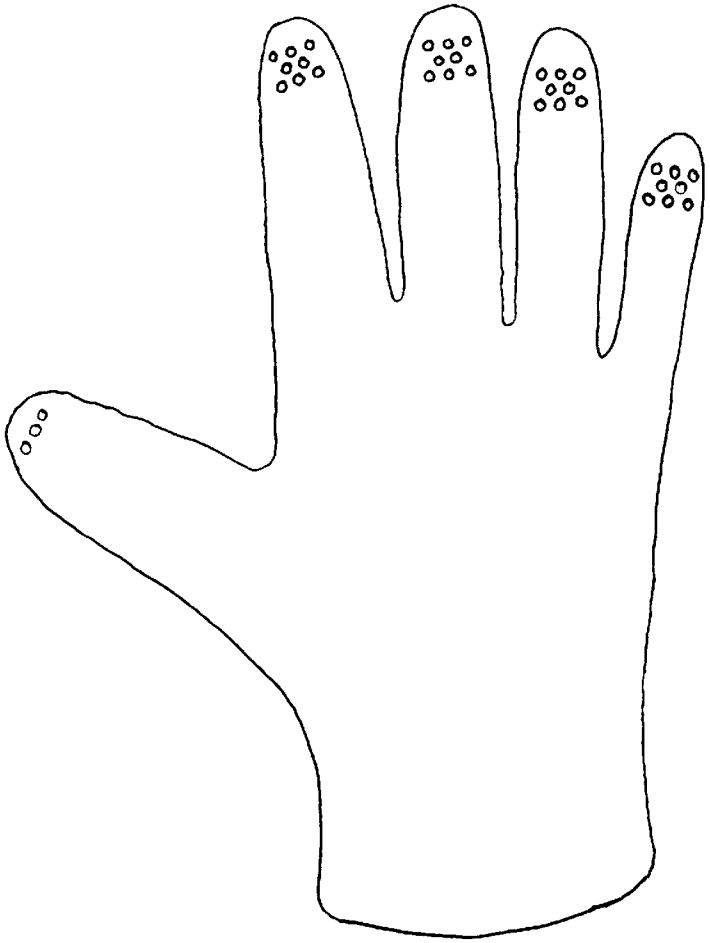
FIG. 5 is another view of the interior of a glove utilizing the present invention.

In actual use, such a glove 100 or hand cover may cover the entire hand, or only a portion of the hand, such as a palm 101, or palm plus fingers 102, 103, 104, 105 and thumb 106, or palm plus partial finger coverage (eg, portions of the tip of the fingers and thumb removed). The texture on the interior of the glove may be formed by any convenient manner and any acceptable material (This could be applications such as, but not limited to: topical screening and spray applied). Customized placement of the texture on the interior surface areas will be done based on ultimate design needs. As an example, the contact or stimulating zone or zones (e.g. "fingerprint zone ") would be potentially different for a glove designed for gardening than for one designed for driving a vehicle, or for one designed for playing golf. The zones can be small (for example, to cover at least one fingertip of a hand, FIG. 5) or can cover the entire interior facing of the glove.

Embodiment 100 includes texture shown on palm 101, finger 102 and thumb 106. These zones can be formed with the same texture, or they could be formed with different textures as shown. The zones could be isolated as shown (zones 101*a* and 101*b*) by areas without any projections 101*c*, or could be unified over the entire interior facing of the glove.

Figure 2:
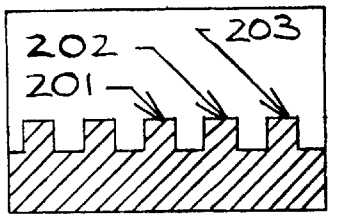
FIG. 2 is cross section view of the interior facing of a glove showing one possible embodiment of the present invention.

Turning now to FIG. 2, there is shown a cross section of one embodiment of texture 200. Here texture 200 is a uniform pattern of firm projections 201, 202, 203.

Figure 3:
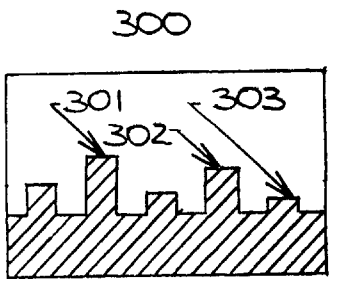
FIG. 3 is a cross section view of an alternative embodiment of the present invention.
Figure 4:
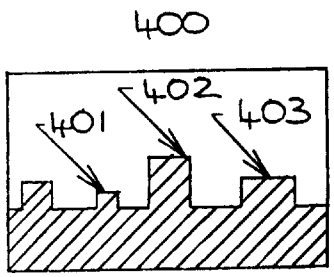
FIG. 4 is another cross section view of an alternative embodiment of the present invention.

Projections 201, 202, 203 are substantially equally spaced, and have substantially uniform height. Alternatively, as shown in FIG. 3, texture 300 may be a non-uniform or random projections 301, 302, 303 of varying height. In addition, as shown in FIG. 4, texture 400 may have projections of random height and spacing as shown by projections 401, 402 and 403, each of which has a different height and spacing from the other. While projections 201, 202, 203 and 301, 302, 303, and 401, 402, 403 have been shown as having flat tops, they could just as easily have rounded tops, or be a mixture of flat and rounded tops.

While certain features of the invention have been illustrated and described herein, many modifications, substitutions, changes and equivalents will now occur to those skilled in the art. It is, therefore, to be understood that the appended claims are intended to cover all such modifications and changes as fall within the true spirit of the invention.

What I claim is:

1. An improved hand cover comprising:

a textured surface formed of a uniform pattern of solid, raised projections that is positioned to contact a stimulating zone on the skin of the palm side of a hand, wherein said projections are of non-uniform height and have substantially flat tops.

2. The improved hand cover of claim 1, wherein said textured surface is positioned to contact at least one finger of a hand.

3. A glove with fingers having a textured surface formed of a uniform pattern of firm, substantially solid projections only on an interior of the finger portions wherein the textured surface is positioned to contact the fingerprint zone of a wearer.

4. The glove of claim 3, wherein the projections have substantially flat tops.

5. A method of manufacturing an extra sensory glove having an interior comprising the step of forming a textured uniform pattern of firm, substantially solid projections on selected portions of less than all the interior of a glove wherein the selected portions each are designed to contact a stimulating zone on a palm side of a wearer's hand wherein the projections have flat tops.

6. The method of claim 5 wherein the projections are of equal height.

7. The method of claim 5 wherein the projections have rounded tops.

8. An improved hand cover comprising:

at least two separate textured surfaces, each formed of a uniform pattern of solid, raised projections that are positioned to contact at least two different stimulating zones on the palm side of a wearer's hand wherein each of the separate textured surfaces is spaced from the other separate textured surfaces by areas without any projections.

9. The hand cover of claim 8 wherein at least one of the separate textured surfaces has a different uniform pattern than the other separate textured surfaces.

* * * * *